US011244610B2

(12) United States Patent
Li

(10) Patent No.: US 11,244,610 B2
(45) Date of Patent: Feb. 8, 2022

(54) DISPLAY PANEL, DISPLAY DEVICE AND CONTROL METHOD FOR DISPLAY PANEL

(71) Applicant: BOE TECHNOLOGY GROUP CO., LTD., Beijing (CN)

(72) Inventor: Yongqian Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 686 days.

(21) Appl. No.: 16/081,489

(22) PCT Filed: Feb. 9, 2018

(86) PCT No.: PCT/CN2018/075953
§ 371 (c)(1),
(2) Date: Aug. 31, 2018

(87) PCT Pub. No.: WO2019/000960
PCT Pub. Date: Jan. 3, 2019

(65) Prior Publication Data

US 2021/0193034 A1 Jun. 24, 2021

(30) Foreign Application Priority Data

Jun. 30, 2017 (CN) ..... 201710525952.9

(51) Int. Cl.
*G09G 3/3233* (2016.01)

(52) U.S. Cl.
CPC ... *G09G 3/3233* (2013.01); *G09G 2300/0819* (2013.01); *G09G 2320/0233* (2013.01); *G09G 2330/02* (2013.01)

(58) Field of Classification Search
CPC ..... G09G 3/3233; G09G 2330/02; G09G 2320/0233; G09G 2300/0819
See application file for complete search history.

(56) References Cited

U.S. PATENT DOCUMENTS

2008/0074412 A1 3/2008 Nozawa
2010/0156881 A1 6/2010 Kohno et al.
(Continued)

FOREIGN PATENT DOCUMENTS

CN 101101729 A 1/2008
CN 103035202 A 4/2013
(Continued)

OTHER PUBLICATIONS

First Office Action for Chinese Patent Application No. 201710525052.9 dated Nov. 5, 2018.
(Continued)

*Primary Examiner* — Jeff Piziali
(74) *Attorney, Agent, or Firm* — Calfee, Halter & Griswold LLP

(57) ABSTRACT

A display panel, a display device and a control method for a display panel are provided. The display panel comprises a plurality of pixel circuits, each of which includes a driving transistor, an energy storage unit, a data writing unit, a reset unit, a compensation unit, and a light emitting unit. The display panel further comprises a driving circuit, which is used to control the compensation unit during a compensation period so as to disconnect the other terminal of the energy storage unit from one terminal of the light emitting unit, so that the light emitting unit in each of the pixel circuits is in an extinguished state.

5 Claims, 3 Drawing Sheets

(56) References Cited

U.S. PATENT DOCUMENTS

| | | | | |
|---|---|---|---|---|
| 2012/0038612 | A1 | 2/2012 | Chung et al. | |
| 2012/0293482 | A1 | 11/2012 | Wu et al. | |
| 2013/0057532 | A1 | 3/2013 | Lee et al. | |
| 2016/0055791 | A1* | 2/2016 | Kishi | G09G 3/30 345/212 |
| 2016/0148564 | A1* | 5/2016 | Kim | G09G 3/3233 345/211 |
| 2016/0163265 | A1* | 6/2016 | Yang | G09G 3/3233 345/690 |
| 2016/0189621 | A1* | 6/2016 | Kim | G09G 3/3258 345/215 |
| 2016/0189625 | A1 | 6/2016 | Kim et al. | |
| 2016/0286622 | A1 | 9/2016 | Gai et al. | |
| 2016/0343278 | A1* | 11/2016 | Tsujita | G09G 3/3233 |
| 2017/0193918 | A1* | 7/2017 | Bae | G09G 3/3291 |

FOREIGN PATENT DOCUMENTS

| | | | |
|---|---|---|---|
| CN | 104200779 | A | 12/2014 |
| CN | 104658485 | A | 5/2015 |
| CN | 105741761 | A | 7/2016 |
| CN | 106297668 | A | 1/2017 |
| CN | 106652904 | A | 5/2017 |
| CN | 107086025 | A | 8/2017 |
| EP | 2525348 | A2 | 11/2012 |
| EP | 3040962 | | 6/2016 |
| JP | 2010-170079 | | 8/2010 |
| KR | 20150079308 | A | 7/2015 |
| WO | 2004088826 | A1 | 10/2004 |

OTHER PUBLICATIONS

Search Report and Written Opinion for International Application No. PCT/CN2018/075953 dated Apr. 13, 2018.

European Search Report from 18825205.0 dated Feb. 8, 2021.

Office Action from Japanese Patent Application No. 2019-552901 dated Oct. 11, 2021.

Office Action from Japanese Patent Application No. 2019-552901 dated Oct. 1, 2021.

* cited by examiner

DISPLAY PANEL, DISPLAY DEVICE AND CONTROL METHOD FOR DISPLAY PANEL

RELATED APPLICATION

The present application is the U.S. national phase entry of PCT/CN2018/075953, with an international filling date of Feb. 9, 2018, which claims the benefit of Chinese Patent Application No. 201710525952.9, filed on Jun. 30, 2017, the entire disclosure of which is incorporated herein by reference.

TECHNICAL FIELD

The present disclosure relates to the field of display technologies, particularly to a display panel, a display device and a control method for a display panel.

BACKGROUND

For an Organic Light Emitting Diode (OLED) display device, the display brightness thereof is proportional to the driving current for the OLED device. When the OLED device is lit, the pixel circuit provides a corresponding driving current to the OLED device, thereby forming a passage of current from a power supply voltage ELVDD to the cathode ELVSS of the OLED.

However, for the existing OLED display device, the display brightness is generally uneven when an image is being displayed, and the display unevenness gets more serious as the display area of the OLED display device becomes larger.

SUMMARY

The display panel according to an embodiment of the present disclosure comprises a plurality of pixel circuits, each of the plurality of pixel circuits includes a driving transistor, an energy storage unit, a data writing unit, a reset unit, a compensation unit, and a light emitting unit, a first terminal of the driving transistor being used for receiving a power supply voltage, a control terminal of the driving transistor being connected to one terminal of the energy storage unit and the data writing unit, respectively, a second terminal of the driving transistor being connected to the other terminal of the energy storage unit, the reset unit and a first terminal of the compensation unit, respectively, a second terminal of the compensation unit being connected to one terminal of the light emitting unit, and the other terminal of the light emitting unit being grounded; a driving circuit, the driving circuit being connected to a control terminal of the compensation unit, the data writing unit and the reset unit in each of the pixel units, respectively, and control terminals of compensation units in the pixel circuits being connected together, the driving circuit being at least used to control the compensation unit during a compensation period so as to disconnect the other terminal of the energy storage unit from the one terminal of the light emitting unit, so that the light emitting unit in each of the pixel circuits is in an extinguished state.

In addition, the display panel according to an embodiment of the present disclosure may further have the following additional technical features.

According to an embodiment of the present disclosure, the compensation unit comprises a first transistor, a first terminal of the first transistor being connected to the first terminal of the compensation unit, a second terminal of the first transistor being connected to the second terminal of the compensation unit, and a control terminal of the first transistor being connected to a control terminal of the compensation unit.

According to an embodiment of the present disclosure, the data writing unit comprises a second transistor, a first terminal of the second transistor being connected to the control terminal of the driving transistor, a second terminal of the second transistor being connected to a data line, and a control terminal of the second transistor being connected to the driving circuit.

According to an embodiment of the present disclosure, the reset unit comprises a third transistor, a first terminal of the third transistor being connected to the second terminal of the driving transistor, a second terminal of the third transistor being connected to a reset line, and a control terminal of the third transistor being connected to the driving circuit.

According to an embodiment of the present disclosure, the driving circuit is further used to control the compensation unit during a light emitting period so as to connect the other terminal of the energy storage unit to the one terminal of the light emitting unit, and to control the data writing unit and the reset unit so as to control light emission of the light emitting unit.

According to an embodiment of the present disclosure, when the driving circuit controls the data writing unit and the reset unit so as to control light emission of the light emitting unit, the driving circuit first outputs a first control signal to the control terminal of the second transistor to bring the second transistor into a turn-on state, and outputs a second control signal to the control terminal of the third transistor to bring the third transistor into a turn-off state, so that a data signal of the data line is written to the one terminal of the energy storage unit, the first transistor is turned on, and the light emitting unit is in a light emitting state; the driving circuit then outputs a third control signal to the control terminal of the third transistor to bring the third transistor into a turn-on state, and outputs a fourth control signal to the control terminal of the second transistor to bring the second transistor into a turn-off state, so that the other terminal of the energy storage unit is reset to a low level signal, and the light emitting unit is in an extinguished state.

Another embodiment of the present disclosure provides a display device comprising the display panel according to any of the foregoing embodiments.

A further embodiment of the present disclosure provides a control method for a display panel. The display panel comprises a plurality of pixel circuits, each of the plurality of pixel circuits includes a driving transistor, an energy storage unit, a data writing unit, a reset unit, a compensation unit and a light emitting unit, a first terminal of the driving transistor being used for receiving a power supply voltage, a control terminal of the driving transistor being connected to one terminal of the energy storage unit and the data writing unit, respectively, a second terminal of the driving transistor being connected to the other terminal of the energy storage unit, the reset unit and a first terminal of the compensation unit, respectively, a second terminal of the compensation unit being connected to the one terminal of the light emitting unit, the other terminal of the light emitting unit being grounded, and control terminals of compensation units in the pixel circuits being connected together. The control method comprises a step of controlling the compensation unit during a compensation period to disconnect the other terminal of the energy storage unit from the one terminal of the light emitting unit so that the light emitting unit in each of the pixel circuits is in an extinguished state.

In addition, the control method for a display panel according to the above embodiment of the present disclosure may further have the following additional technical features.

According to an embodiment of the present disclosure, the compensation unit comprises a first transistor, a first terminal of the first transistor being connected to the first terminal of the compensation unit, a second terminal of the first transistor being connected to the second terminal of the compensation unit, and a control terminal of the first transistor being connected to a control terminal of the compensation unit.

According to an embodiment of the present disclosure, the data writing unit comprises a second transistor, a first terminal of the second transistor being connected to the control terminal of the driving transistor, and a second terminal of the second transistor being connected to a data line; the reset unit comprises a third transistor, a first terminal of the third transistor being connected to the second terminal of the driving transistor, and a second terminal of the third transistor being connected to a reset line.

According to an embodiment of the present disclosure, the control method for a display panel further comprises controlling the compensation unit during a light emitting period to connect the other terminal of the energy storage unit to the one terminal of the light emitting unit, and controlling the data writing unit and the reset unit so as to control light emission of the light emitting unit.

According to an embodiment of the present disclosure, controlling the data writing unit and the reset unit so as to control light emission of the light emitting unit comprises: first outputting a first control signal to the control terminal of the second transistor to bring the second transistor into a turn-on state, and outputting a second control signal to the control terminal of the third transistor to bring the third transistor into a turn-off state, so that a data signal of the data line is written to the one terminal of the energy storage unit, the first transistor is turned on, and the light emitting unit is in a light emitting state; and further outputting a third control signal to the control terminal of the third transistor to bring the third transistor into a turn-on state, and outputting a fourth control signal to the control terminal of the second transistor to bring the second transistor into a turn-off state, so that the other terminal of the energy storage unit is reset to a low level signal, and the light emitting unit is in an extinguished state.

DETAILED DESCRIPTION OF EMBODIMENTS

Figure 1:
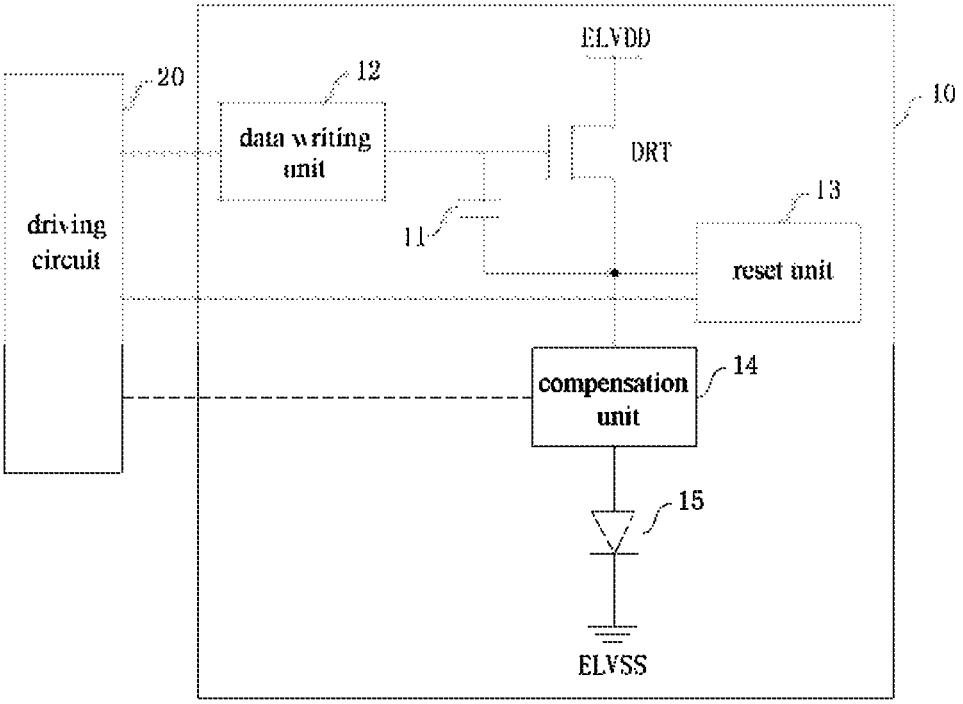
FIG. 1 is a schematic view of a display panel according to an embodiment of the present disclosure.

Embodiments of the present disclosure are described in detail below, and examples of the embodiments are illustrated in the drawings, throughout the same or similar reference numerals are used to refer to the same or similar elements or elements having the same or similar functions. The embodiments described below with reference to the drawings are illustrative, which are intermingled to explain the invention and are not to be construed as limiting it.

Inventors of the application have found that, for an OLED display device, after a voltage source voltage ELVDD is provided outside an active area, it is transmitted to each pixel circuit through a wire in the active area. During the transmission, since the wire has a certain resistance, a DC voltage drop (which can be called IR drop) will be generated.

Due to the IR drop, the distribution of the power supply voltage ELVDD in the active area is uneven. In particular, the actual power supply voltage for each pixel circuit is VDD_pixel=ELVDD-I*R, where I is the current value of an ELVDD signal network, and R is the resistance of a wire from the pixel circuit to a power supply voltage ELVDD input terminal. Since the wire traces from respective pixel circuits to the power supply voltage ELVDD input terminal differ in length, the resistance R of each wire is different, that is, the IR drop is different. When the driving transistor is in a saturated state, the pixel currents of the pixel circuits are different, e.g., $I=\mu CoxW(ELVDD-I*R-Vdata-Vth)^2/(2L)$, which further causes display unevenness. Moreover, the larger the display area is, the larger the IR drop will be, and the more serious the display unevenness is.

Regarding the display unevenness, a compensation pixel circuit may be used to compensate the threshold voltage Vth of the driving transistor in the pixel circuit, but this still cannot solve the display unevenness resulting from the DC voltage drop (IR drop) of the power supply voltage. Embodiments of the present disclosure are directed to alleviating or solving this problem.

The display panel, the display device, and the control method for a display panel proposed by embodiments of the present disclosure will be described below with reference to the accompanying drawings.

FIG. 1 is a schematic view of a display panel according to an embodiment of the present disclosure. As shown in FIG. 1, the display panel according to an embodiment of the disclosure may comprise a plurality of pixel circuits 10 (one pixel circuit 10 is shown as an example in the figure) and a driving circuit 20.

Each of the plurality of pixel circuits 10 includes a driving transistor DRT, an energy storage unit 11, a data writing unit 12, a reset unit 13, a compensation unit 14, and a light emitting unit 15. A first terminal of the driving transistor DRT is used for receiving a power supply voltage (for example, it is connected to a preset power supply ELVDD), a control terminal of the driving transistor DRT is connected to a terminal of the energy storage unit 11 and the data writing unit 12, respectively, and a second terminal of the driving transistor DRT is connected to the other terminal of the energy storage unit 11, a reset unit 13, and a first terminal of the compensation unit 14, respectively. A second terminal of the compensation unit 14 is connected to one terminal of the light emitting unit 15, and the other terminal of the light emitting unit 15 is grounded to ELVSS.

The driving circuit 20 is connected to a control terminal of the compensation unit 14, the data writing unit 12 and the reset unit 13 in each pixel circuit 10, respectively, and the control terminals of the compensation units 14 in all the pixel circuits 10 are connected together. The driving circuit 20 is used to control the compensation unit 14 during a light emitting period so as to connect the other terminal of the energy storage unit 11 to one terminal of the light emitting unit 15, and control the data writing unit 12 and the reset unit 13 so as to control light emission of the light emitting unit 15, and to control the compensation unit 14 during a compensation period so as to disconnect the other terminal of the energy storage unit 11 from the light emitting unit 15, so that the light emitting unit 15 in each pixel circuit 10 is in an extinguished state.

Specifically, a light emitting phase (light emitting period) and a compensation phase (compensation period) are included in one-frame image time. In the light emitting phase, the driving circuit 20 controls the compensation unit 14 so that the other terminal of the energy storage unit 11 of each pixel circuit 10 is connected to a terminal of a corresponding light emitting unit 15. At that time, the driving circuit 20 may control light emission of the light emitting unit 15 in a normal manner. For example, the driving circuit 20 may first control the data writing unit 12 in a pixel circuit 10 of a certain row to write a data signal to one terminal of the energy storage unit 11, the driving transistor DRT is turned on under the effect of the data signal, and the light emitting unit 15 is in a light emitting state. The driving circuit 20 then controls the data writing unit 12 in the pixel circuit 10 of this row to stop outputting the data signal to the terminal of the energy storage unit 11, and at the same time controls the reset unit 13 to output a reset signal to the other terminal of the energy storage unit 11, so that the voltage at the other terminal of the energy storage unit 11 is the same as the ground ELVSS, so the light emitting unit 15 is extinguished. Thereafter, the driving circuit 20 performs to control pixel circuits 10 of a next row in the way described above until control to light emission of all the pixel circuits 10 has been completed, and the compensation phase begins.

The compensation phase is mainly used to acquire compensation data for each pixel circuit 10. However, during the process of acquiring compensation data (i.e., during the Sense period), expect that the pixel circuit 10, for which compensation data needs to be acquired, is in an extinguished state, all the other pixel circuits 10 are in a light emitting state. Therefore, the image displayed is uneven under the influence of the IR drop. Moreover, for different images displayed, different IR drops would occur, which will result in inconsistency between the compensation data acquired successively. When there is a significant difference between the compensation data, it will cause various Mura (display brightness unevenness), such as stripes and shadows.

Therefore, in the compensation phase, the driving circuit 20 controls the compensation unit 14 so that the other terminal of the energy storage unit 11 of each pixel circuit 10 is disconnected from one terminal of a corresponding light emitting unit 15. At that time, regardless of whether the voltage at the other terminal of the energy storage unit 11 is high or low, the light emitting unit 15 is in an extinguished state, thereby guaranteeing a full-screen black state during the Sense period. In this way, without changing the driving frequency (typically, to achieve black insertion, the driving frequency needs to be doubled, and black insertion is performed using doubled one-full-frame time, while in this disclosure, black insertion is forcibly performed during the Sense period, so it is not required to change the driving frequency), black insertion is forcibly performed during the Sense period, which can guarantee a black screen during the Sense period, compensate the IR drop resulting from the large size of the display panel and the aging of the driving transistor, effectively eliminate the influence of the IR drop, ensure that the state of the pixel circuit is not disturbed during the compensation period, and at the same time effectively eliminate various Mura resulting from a great difference between two successively acquired compensation data caused by a sudden change in the displayed image.

To make the disclosure more apparent to those skilled in the art, detailed description will be made below in conjunction with a specific example of the present disclosure.

Figure 2:
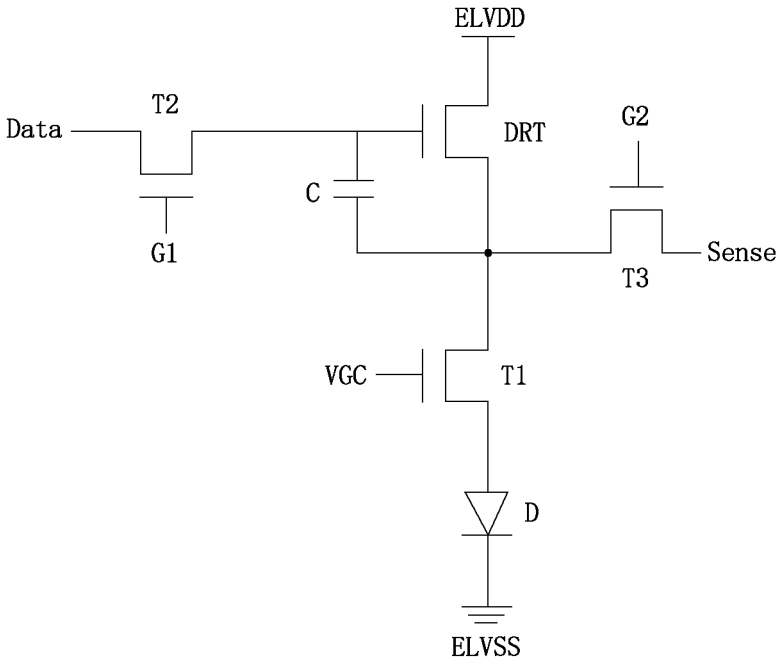
FIG. 2 is a structural diagram of a pixel circuit in the display panel according to an embodiment of the present disclosure.

According to an embodiment of the present disclosure, as shown in FIG. 2, the compensation unit 14 comprises a first transistor T1. A first terminal of the first transistor T1 is connected to a first terminal of the compensation unit 14, a second terminal of the first transistor T1 is connected to a second terminal of the compensation unit 14, and a control terminal of the first transistor T1 is connected to a control terminal of the compensation unit 14.

Further, as shown in FIG. 2, the data writing unit 12 comprises a second transistor T2. A first terminal of the second transistor T2 is connected to the control terminal of the driving transistor DRT, a second terminal of the second transistor T2 is connected to a data line Data, and a control terminal of the second transistor T2 is connected to the driving circuit 20.

Further, as shown in FIG. 2, the reset unit 13 comprises a third transistor T3. A first terminal of the third transistor T3 is connected to the second terminal of the driving transistor DRT, a second terminal of the third transistor T3 is connected to a reset line Sense, and a control terminal of the third transistor T3 is connected to the driving circuit 20. In addition, the energy storage unit 11 may be a capacitor C, the light emitting unit 15 may be a light emitting diode D, and the driving circuit 20 may be disposed outside the plurality of pixel circuits 10, i.e., outside the active area.

When the driving circuit 20 controls the data writing unit 12 and the reset unit 13 so as to control light emission of the light emitting unit 15, the driving circuit 20 firstly outputs a first control signal to the control terminal of the second transistor T2 to bring the second transistor T2 into a turn-on state, and outputs a second control signal to the control terminal of the third transistor T3 to bring the third transistor T3 into a turn-off state, so that the data signal of the data line Data is written to a terminal of the energy storage unit 11, the first transistor T1 is turned on, and the light emitting unit 15 is in a light emitting state. The driving circuit 20 further outputs a third control signal to the control terminal of the third transistor T3 to bring the third transistor T3 into a turn-on state, and outputs a fourth control signal to the control terminal of the second transistor T2 to bring the second transistor T2 into a turn-off state, so that the other terminal of the energy storage unit 11 is reset to a low level signal, and the light emitting unit 15 is in an extinguished state.

Figure 3:
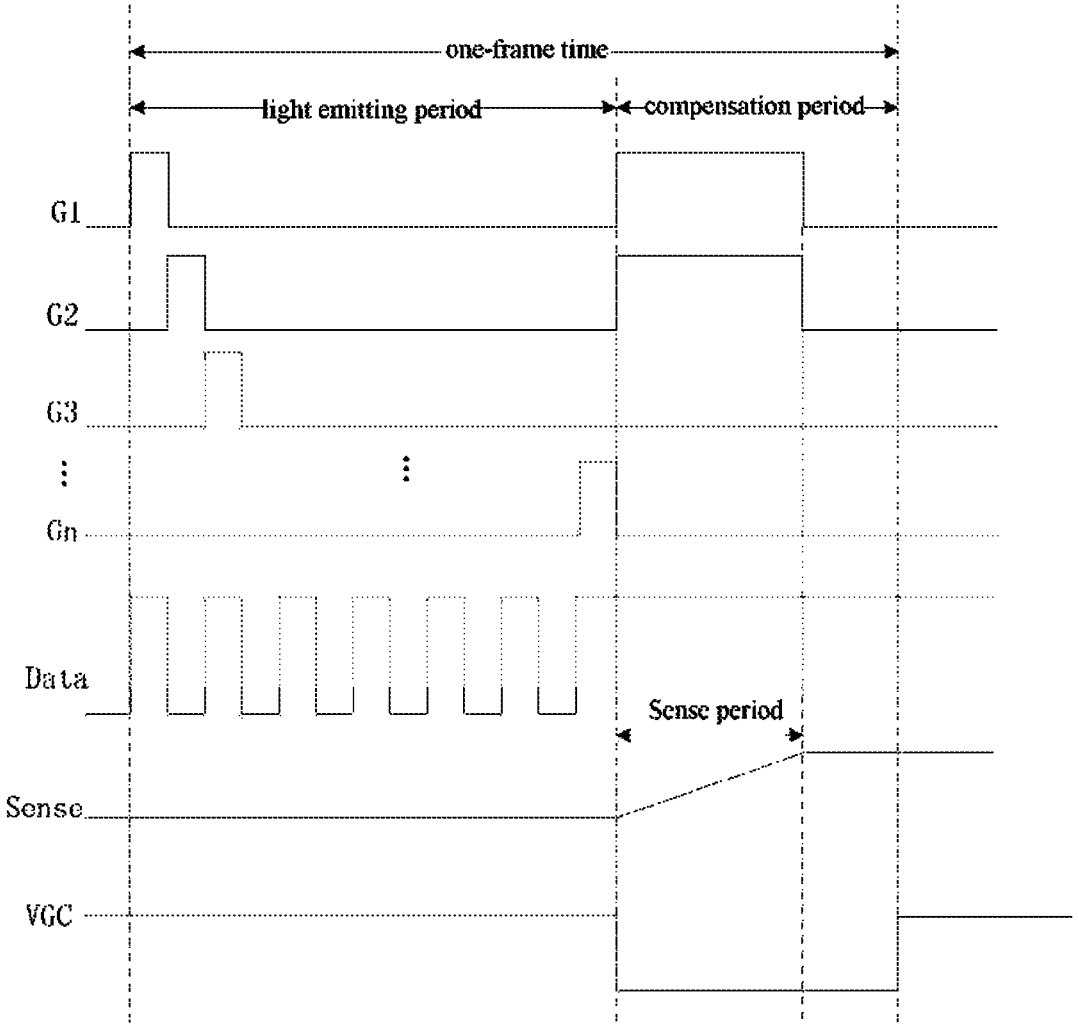
FIG. 3 is a schematic diagram showing the operating principle of the display panel according to an embodiment of the present disclosure.

Specifically, as shown in FIG. 3, a light emitting phase and a compensation phase are included in one-frame image time. In the light emitting phase, the driving circuit 20 outputs a high level signal to the control terminal of the first transistor T1 to turn on the first transistor T1. Since the control terminals of the first transistors T1 in the pixel circuits 10 are all connected, in the light emitting phase, the first transistors T1 in all the pixel circuits 10 are in a turn-on state. During this period, the driving circuit 20 performs progressive scanning to the plurality of pixel circuits. That is, the driving circuit 20 first outputs a high level signal to the control terminals of the second transistors T2 in pixel circuits 10 of the first row, so that all the second transistors T2 in the pixel circuits 10 of the first row are in a turn-on state to input the data signal Data to one terminal of a corresponding capacitor C. At that time, the driving transistor DRT is iii turned on, and the light emitting diode D is in a light emitting state. Then, the driving circuit 20 outputs a low level signal to the second transistors T2 in the pixel circuits 10 of the first row so that all the second transistors T2 in the pixel circuits 10 of the first row are in a turn-off state, and simultaneously outputs a high level signal to the third transistors T3 in the pixel circuits 10 of the first row, so that all the third transistors T3 in the pixel circuits 10 of the first row are in a turn-on state. Since the signal Sense on the reset line is a low level signal (called a reset signal) at that time, even if the first transistor T1 is turned on, the light emitting diode D is still extinguished under the effect of the low level signal. So far, scanning of the pixel circuits 10 of the first row is completed.

After scanning of the pixel circuits 10 of the first row is completed, scanning is performed to pixel circuits 10 of the second row in the manner described above, and the scanning is sequentially executed until scanning of pixel circuits 10 of each row is carried out. The entire light emitting phase ends, and the compensation phase begins.

In the compensation phase, when it is necessary to externally compensate pixel circuits 10 of a certain row, i.e., to compensate the threshold voltage Vth of the driving transistor DRT, the driving circuit 20 simultaneously outputs a high level signal to the control terminal of the second transistor T2 and the control terminal of the third transistor T3, so that the second transistor T2 and the third transistor T3 are both in a turn-on state. At that time, the signal Sense on the reset line is gradually increased from a low level signal, and when the signal Sense is increased to a required compensation voltage (since the compensation voltage is relatively small and smaller than the forward conduction voltage drop of the light emitting diode D, the light emitting diode D does not emit light), the driving circuit 20 simultaneously outputs a low level signal to the second transistor T2 and the third transistor T3, so that the second transistor T2 and the third transistor T3 are turned off to save the compensation voltage. When the driving circuit 20 drives the pixel circuit 10 to emit light in the next frame, a compensation to the threshold voltage Vth of the driving transistor DRT can be achieved by the compensation voltage.

In addition, during this period, in order to avoid the influence of the IR drop, the driving circuit 20 further outputs a low level signal to the control terminal of the first transistor T1 to bring the first transistor T1 into a turn-off state. Since the control terminals of the first transistors of all the pixel circuits 10 are connected together, the first transistor T1 of each pixel circuit 10 is in a turn-off state, and the display screen is in a black state, which can effectively eliminate the influence of the IR drop, ensure that the state of the pixel circuit is not disturbed during the compensation period, and at the same time eliminate various Mura resulting from a great difference between successively acquired compensation data caused by a sudden change in the displayed image.

It can be understood that embodiments of the present disclosure are applicable not only to a 3T1C pixel circuit shown in FIG. 2 but also to other types of pixel circuits, such as 2T1C, 4T1C pixel circuits, and the like, so as to solve the problem of display unevenness resulting from the large size of the display panel and poor saturation characteristics of the driving transistors, which is not specifically described herein.

In summary, for the display panel according to embodiments of the present disclosure, a compensation unit is added between the driving transistor and the light emitting unit, and the compensation unit is controlled during the compensation period to disconnect the other terminal of the energy storage unit from a terminal of the light emitting unit, so that the light emitting unit in each pixel circuit is in an extinguished state, thereby inserting black forcibly during the compensation period to make the display panel show a black state during the compensation period, effectively eliminating the influence of the IR drop, and ensuring that the pixel circuit is not disturbed during the compensation period.

Figure 4:
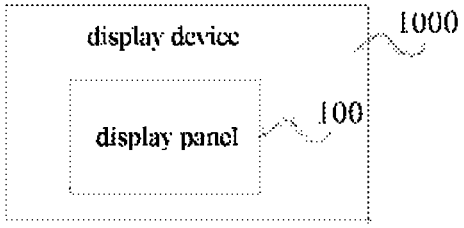
FIG. 4 is a schematic block diagram of a display device according to an embodiment of the present disclosure.

FIG. 4 is a schematic block diagram of a display device according to an embodiment of the present disclosure. As shown in FIG. 4, a display device 1000 according to the embodiment of the present disclosure may include a display panel 100 described above.

For the display device according to the embodiment of the present disclosure with the display panel described above, black insertion is performed forcibly during the compensation period so that the displayed image is in a black state during the compensation period, thereby effectively eliminating the influence of the IR drop, ensuring that the pixel circuit is not disturbed during the compensation period, and further improving the display effect of the display device.

Figure 5:
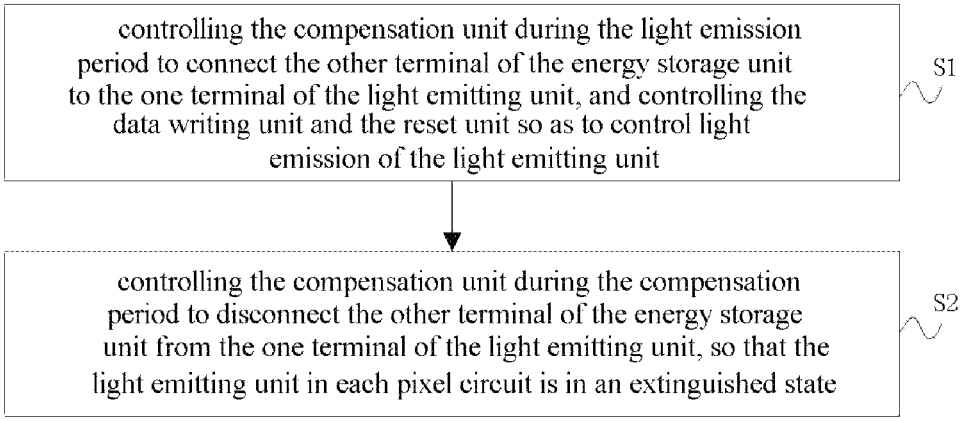
FIG. 5 is a flowchart of a control method for a display panel according to an embodiment of the present disclosure.

FIG. 5 is a flowchart of a control method for a display panel according to an embodiment of the present disclosure.

In this embodiment of the disclosure, as shown in FIG. 1, the display panel comprises a plurality of pixel circuits, each of which includes a driving transistor, an energy storage unit, a data writing unit, a reset unit, a compensation unit and a light emitting unit. A first terminal of the driving transistor is connected to a preset power supply, and a control terminal of the driving transistor is connected to one terminal of the energy storage unit and the data writing unit, respectively, and a second terminal of the driving transistor is connected to the other terminal of the energy storage unit, the reset unit, and a first terminal of the compensation unit, respectively. A second terminal of the compensation unit is connected to one terminal of the light emitting unit, the other terminal of the light emitting unit is grounded, and control terminals of the compensation units in all the pixel circuits are connected together.

As shown in FIG. 5, the control method for a display panel according to the embodiment of the disclosure comprises the following steps:

S1, controlling the compensation unit during a light emission period to connect the other terminal of the energy storage unit to one terminal of the light emitting unit, and controlling the data writing unit and the reset unit so as to control light emission of the light emitting unit.

S2, controlling the compensation unit during a compensation period to disconnect the other terminal of the energy storage unit from one terminal of the light emitting unit, so that the light emitting unit in each pixel circuit is in an extinguished state.

Specifically, according to an embodiment of the present disclosure, as shown in FIG. 2, the compensation unit comprises a first transistor. A first terminal of the first transistor is connected to the first terminal of the compensation unit, a second terminal of the first transistor is connected to the second terminal of the compensation unit, and a control terminal of the first transistor is connected to the control terminal of the compensation unit.

Further, as shown in FIG. 2, the data writing unit comprises a second transistor. A first terminal of the second transistor is connected to the control terminal of the driving transistor, and a second terminal of the second transistor is connected to the data line. The reset unit comprises a third transistor. A first terminal of the third transistor is connected to the second terminal of the driving transistor, and a second terminal of the third transistor is connected to the reset line.

Controlling the data writing unit and the reset unit so as to control light emission of the light emitting unit comprises: first outputting a first control signal to the control terminal of the second transistor to bring the second transistor into a turn-on state, and outputting a second control signal to the control terminal of the third transistor to bring the third transistor into a turn-off state, so that the data signal of the data line is written to one terminal of the energy storage unit, the first transistor is turned on, and the light emitting unit is in a light emitting state; then outputting a third control signal to the control terminal of the third transistor to bring the third transistor into a turn-on state, and outputting a fourth control signal to the control terminal of the second transistor to bring the second transistor into a turn-off state, so that the other terminal of the energy storage unit is reset to a low level signal, and the light emitting unit is in an extinguished state.

It is to be noted that, as for details not depicted for the control method for a display panel, reference can be made to the details disclosed for the display panel according to the embodiments of the disclosure, and the repeated description is omitted herein.

For the control method for a display panel according to the embodiment of the disclosure, a compensation unit is added between the driving transistor and the light emitting unit, and the compensation unit is controlled during the compensation period to disconnect the other terminal of the energy storage unit from one terminal of the light emitting unit, so that the light emitting unit in each pixel circuit is in an extinguished state, thereby forcibly inserting black during the compensation period to achieve a black state of the display panel during the compensation period, effectively eliminating the influence of the IR drop, and ensuring that the pixel circuit is not disturbed during the compensation period.

In the description of the disclosure, it is to be understood that the orientations or positional relationships denoted by the terms such as "center", "longitudinal", "transverse", "length", "width", "thickness", "upper", "lower", "front", "back", "left", "right", "vertical", "horizontal", "top", "bottom", "inside", "outside", "clockwise", "counterclockwise", "axial", "radial", "circumferential", and the like are based on the orientations or positional relationships shown in the drawings, and are merely for the convenience of describing and simplifying the description, rather than indicating or implying that the denoted device or element must have a particular orientation, or must be constructed and operated in a particular orientation, which are not to be construed as limiting the invention.

Moreover, the terms "first" and "second" are used for descriptive purposes only and are not to be construed as indicating or implying a relative importance or implicitly indicating the number of technical features indicated. Thus, features defined with "first" or "second" may include at least one feature, either explicitly or implicitly. In the description of the disclosure, "plurality" means at least two, such as two, three, etc., unless otherwise defined.

In the present disclosure, the terms "install", "link", "connect", "fix", and the like are to be understood in a broad sense, which may be, for example, a fixed connection or a detachable connection, or integrated; a mechanical connection or an electrical connection; directly connected or indirectly connected through an intermediate medium; an internal communication between two elements or an interaction between two elements, unless otherwise specified. For those ordinarily skilled in the art, specific meanings of the above terms in the present disclosure can be understood on a case-by-case basis.

In the present disclosure, a first feature being "on" or "under" a second feature may indicate a direct contact between the first feature and the second feature, or an indirect contact between the first feature and the second feature through an intermediate medium, unless otherwise specified and defined. Moreover, a first feature being "on", "above" and "over" a second feature may indicate that the first feature is directly above or obliquely above the second feature, or merely indicate that the level height of the first feature is higher than that of the second feature. A first feature being "under", "below" and "beneath" a second feature may indicate that the first feature is directly below or obliquely below the second feature, or merely indicate that the level height of the first feature is lower than that of the second feature.

In the description of the present specification, the description with reference to the terms "an embodiment", "some embodiments", "example", "specific example", or "some examples" and the like means that specific features, structures, materials or characteristics described in connection with the embodiments or examples are included in at least one embodiment or example of the present disclosure. In the present specification, the schematic expressions of the above terms are not necessarily directed to the same embodiments or examples. Furthermore, the specific features, structures, materials, or characteristics described may be combined in a suitable manner in any one or more embodiments or examples. In addition, various embodiments or examples described in the specification, as well as features of various embodiments or examples, may be combined by those skilled in the art without causing any contradiction.

While the embodiments of the disclosure have been shown and described above, it can be understood that the foregoing embodiments are illustrative and are not to be construed as limiting the present invention. Variations, amendments, substitutions and modifications may be made by those ordinarily skilled in the art to the foregoing embodiments within the scope of the present invention.

The invention claimed is:

1. A method for controlling a display panel, where the display panel comprises:

a plurality of pixel circuits, each of the plurality of pixel circuits includes a driving transistor, an energy storage unit, a data writing unit, a reset unit, a compensation unit and a light emitting unit, a first terminal of the driving transistor being used for receiving a power supply voltage, a control terminal of the driving transistor being connected to a first terminal of the energy storage unit and the data writing unit, respectively, a second terminal of the driving transistor being connected to a second terminal of the energy storage unit, the reset unit and a first terminal of the compensation unit, respectively, a second terminal of the compensation unit being connected to a first terminal of the light emitting unit, a second terminal of the light emitting unit being grounded, and control terminals of compensation units in the pixel circuits being connected together, wherein the data writing unit comprises a second transistor, a first terminal of the second transitory is connected to the control terminal of the driving transistor, and a second terminal of the second transistor is connected to a data line, and wherein the reset unit comprises a third transistor, a first terminal of the third transistor is connected to the second terminal of the driving transistor, and a second terminal of the third transistor is connected to a reset line, wherein the method comprises:

controlling the compensation unit during a compensation period to disconnect the second terminal of the energy storage unit from the first terminal of the light emitting unit so that the light emitting unit in each of the pixel circuits is in an extinguished state, and during the compensation period, controlling the second transistor and the third transistor to be a turn-on state, gradually increasing a voltage of the reset line from a low level signal to a compensation voltage, and controlling the second transistor and the third transistor to be a turn-off state to save the compensation voltage when the voltage of the reset line reaches the compensation voltage.

2. The method for controlling a display panel according to claim 1, wherein the compensation unit comprises a first transistor, a first terminal of the first transistor being connected to the first terminal of the compensation unit, a second terminal of the first transistor being connected to the second terminal of the compensation unit, and a control terminal of the first transistor being connected to a control terminal of the compensation unit.

3. The method for controlling a display panel according to claim 1, further comprising: controlling the compensation unit during a light emitting period to connect the second terminal of the energy storage unit to the first terminal of the light emitting unit, and controlling the data writing unit and the reset unit so as to control light emission of the light emitting unit.

4. The method for controlling a display panel according to claim 3, wherein controlling the data writing unit and the reset unit so as to control light emission of the light emitting unit comprises:

firstly outputting a first control signal to the control terminal of the second transistor to bring the second transistor into a turn-on state, and outputting a second control signal to the control terminal of the third transistor to bring the third transistor into a turn-off state, so that a data signal of the data line is written to the first terminal of the energy storage unit, the first transistor is turned on, and the light emitting unit is in a light emitting state, and further outputting a third control signal to the control terminal of the third transistor to bring the third transistor into a turn-on state, and outputting a fourth control signal to the control terminal of the second transistor to bring the second transistor into a turn-off state, so that the second terminal of the energy storage unit is reset to a low level signal, and the light emitting unit is in an extinguished state.

5. The method for controlling a display panel according to claim 4, wherein the controlling the data writing unit and the reset unit so as to control light emission of the light emitting unit is performed in sequence for respective rows of pixel circuits of the plurality of pixel circuits before the compensation period begins.

* * * * *